US009358582B2

(12) United States Patent
Benjamins

(10) Patent No.: US 9,358,582 B2
(45) Date of Patent: Jun. 7, 2016

(54) SORTING SCREEN FOR SORTING MATERIAL AND ROTOR BODY FOR SUCH A SORTING SCREEN

(71) Applicant: BOLLEGRAAF PATENTS AND BRANDS B.V., Appingedam (NL)

(72) Inventor: Jan Benjamins, Elim (NL)

(73) Assignee: BOLLEGRAAF PATENTS AND BRANDS B.V., Appingedam (NL)

( * ) Notice: Subject to any disclaimer, the term of this patent is extended or adjusted under 35 U.S.C. 154(b) by 0 days.

(21) Appl. No.: 14/162,238

(22) Filed: Jan. 23, 2014

(65) Prior Publication Data

US 2014/0202933 A1 Jul. 24, 2014

(30) Foreign Application Priority Data

Jan. 23, 2013 (EP) ..... 13152400

(51) Int. Cl.

| | |
|---|---|
| ***B07B 13/00*** | (2006.01) |
| ***B07C 5/12*** | (2006.01) |
| ***B07B 1/15*** | (2006.01) |
| ***B07B 1/14*** | (2006.01) |

(52) U.S. Cl.

CPC . *B07B 1/155* (2013.01); *B07B 1/14* (2013.01); *B07B 1/15* (2013.01)

(58) Field of Classification Search

CPC ..... B07B 1/14; B07B 1/155; B07B 1/12; B07B 1/15; B07B 1/145

USPC ..... 209/659, 660, 667, 672, 673, 676, 679, 209/395

See application file for complete search history.

(56) References Cited

U.S. PATENT DOCUMENTS

| | | | | | |
|---|---|---|---|---|---|
| 4,795,036 | A * | 1/1989 | Williams | B07B 1/15 | 209/667 |
| 5,051,172 | A * | 9/1991 | Gilmore | D21B 1/023 | 209/667 |
| 5,960,964 | A * | 10/1999 | Austin | B07B 1/4636 | 209/353 |
| 6,149,018 | A * | 11/2000 | Austin | B07B 1/4636 | 209/667 |
| 6,237,778 | B1 * | 5/2001 | Weston | A01D 17/06 | 209/667 |
| 6,371,305 | B1 | 4/2002 | Austin et al. | | |
| 8,328,126 | B2 * | 12/2012 | Bruggencate | B02C 4/02 | 241/236 |
| D680,419 | S | 4/2013 | Green et al. | | |
| 8,646,615 | B2 * | 2/2014 | Bruggencate | B07B 1/15 | 209/665 |
| 8,683,918 | B1 * | 4/2014 | Witham | A23N 12/005 | 209/673 |
| 8,857,621 | B2 * | 10/2014 | Campbell | 209/44.2 | |
| 2010/0264069 | A1 * | 10/2010 | Green | B07B 1/15 | 209/262 |
| 2013/0032512 | A1 * | 2/2013 | Presby | B07B 1/18 | 209/255 |

FOREIGN PATENT DOCUMENTS

| | | | |
|---|---|---|---|
| DE | 10 2007 027846 | B3 | 5/2008 |
| GB | 1 295 782 | A | 11/1972 |
| WO | 95/35168 | A1 | 12/1995 |

* cited by examiner

*Primary Examiner* — Prasad Gokhale

(74) *Attorney, Agent, or Firm* — Pearne & Gordon LLP

(57) ABSTRACT

A sorting screen for sorting material comprises a row of rotatable, driven shafts mutually spaced in a conveying direction. Each shaft extends transversally to said conveying direction and carries carrying a row of radially extending rotor bodies for intermittently urging material on the sorting screen upward and in conveying direction. The rotor bodies of each of said rows are mutually spaced in longitudinal direction of the respective shaft by spacers. Each spacer is a tubular spacer and each rotor body is provided with at least a recess or a number of projections retaining a respective end face of a respective tubular spacer.

10 Claims, 2 Drawing Sheets

SORTING SCREEN FOR SORTING MATERIAL AND ROTOR BODY FOR SUCH A SORTING SCREEN

FIELD AND BACKGROUND OF THE INVENTION

The invention relates to a sorting screen for sorting material, such as waste, according to the introductory portion of claim 1 and to a rotor body for such a sorting screen.

Such a rotor body and such a sorting screen are known from WO-A1-95/35168. In this International Patent application a disc screen is described having a screening bed with a series of rotating spaced parallel shafts each of which has a longitudinal series of concentric screen discs separated with spacers. The perimeters of the discs of this known disc screen are shaped such that space between discs of adjacent shafts remains constant during rotation. The discs are held in place by the spacers which comprises central apertures to receive separate hubs therethrough and the discs also comprise central apertures to receive the hubs therethrough. Depending on the character and size of the material to be sorted, the discs may range from about 6 inches major diameter to about 16 inches major diameter. Thus in order to sort material of a different size all the screen discs have to be replaced. Since each screen disc has a specifically shaped perimeter such screen discs are relatively expensive and replacing all of the screen discs of a screening bed involves a relatively high investment. The screen discs are also known as rotor bodies or as star bodies but are not necessarily star-shaped in a narrow-sense.

SUMMARY OF THE INVENTION

It is an object of the invention to provide an alternative sorting screen and rotor body which allow sorting material of different sizes at a relatively low cost.

According to the invention, this object is achieved by providing a sorting screen for sorting material, including a row of rotatable, driven shafts mutually spaced in a conveying direction and each extending transversally to the conveying direction, the shafts each carrying a row of radially extending rotor bodies for intermittently urging material on the sorting screen upward and in conveying direction, the rotor bodies of each of the rows being mutually spaced in longitudinal direction of the respective shaft by spacers, characterized in that a rotor body carried by a shaft projects between rotor bodies carried by a neighboring one of the shafts, in that each spacer is a tubular spacer, and in that each rotor body is provided with a recess and/or a number of projections retaining a respective end face of a respective tubular spacer. The invention can also be embodied in a rotor body for such a sorting screen in which the rotor body is provided with a recess and/or a number of projections for retaining a respective end face of a respective tubular spacer.

Since in accordance with the invention the opening for sorting material of a certain size is defined by the distance between the periphery of a rotor body carried by a shaft and the outer periphery of a spacer mounted on a neighboring one of said shafts, this opening can be adapted by using spacers of different diameters. Since the spacer is a tubular spacer the weight of such a spacer can be relatively low as a result of which the construction of the sorting screen can be relatively simple. Furthermore, such a tubular spacer can be manufactured at relatively low cost and thus leads to a sorting screen which is cheap in comparison to the one known from WO-A1-95/35168. In addition since each rotor body is provided with a recess and/or a number of projections retaining a respective end face of a respective tubular spacer the spacers can be mounted in the sorting screen in a relatively easy manner, in which the use of separate hubs is not necessary but not excluded.

In an embodiment of a sorting screen according to the invention each rotor body is made of a plastic or elastomeric material. In this manner a resilient rotor body is obtained, that can bend sideways relatively easily when objects become stuck between adjacent rotor bodies and thereby such object can be allowed to be expelled from between the rotor bodies without exerting excessively high forces onto the rotor bodies. In addition, the resilient characteristics of the rotor bodies allow impact energy of heavy hard items hitting the rotor bodies to be absorbed relatively smoothly, such that the exertion of high peak loads onto the rotor bodies is avoided. Accordingly, the rotors may be of a lighter construction. Also, noise emissions due to impacts of objects against the rotor bodies are reduced. Nevertheless, due to the positioning of the tubular spacers between rotor bodies the sorting function of the sorting screen remains intact.

In a further embodiment of a sorting screen according to the invention each rotor body is provided with a plurality of recesses and/or a plurality of a number of projections for retaining end faces of tubular spacers of different diameters. In this manner it is possible to mount tubular spacers having different inner diameters between the neighboring rotor bodies without the need of adapting the shafts or the hubs. Preferably a recess is formed by a circular groove for retaining a respective circular end of a tubular shaft. In case each rotor body comprises three circular grooves of different diameter the sorting screen can be adapted in an easy manner to the most common sizes of material to be sorted without the need to replace rotor bodies.

In an even further embodiment of a sorting screen according to the invention each rotor body has an outer circumference with a plurality of radial projections circumferentially distributed around a central axis of rotation and projecting radially outwardly from the axis of rotation relative to intermediate recessed portions of the outer circumference. It appears that by using a sorting screen according to the invention it is possible to use relatively cheap rotor bodies having a more conventional periphery —in stead of the specific periphery disclosed in WO-A1-95/35168—and still obtain a correct sorting of material of different sizes without the risk of jamming of material, in particular when rotor bodies of plastic or elastomeric material are used.

Particular embodiments of a rotor body according to the invention are set forth in the dependent claims.

Further objects, features, effects and details of the invention are described below.

DETAILED DESCRIPTION

Figure 1:
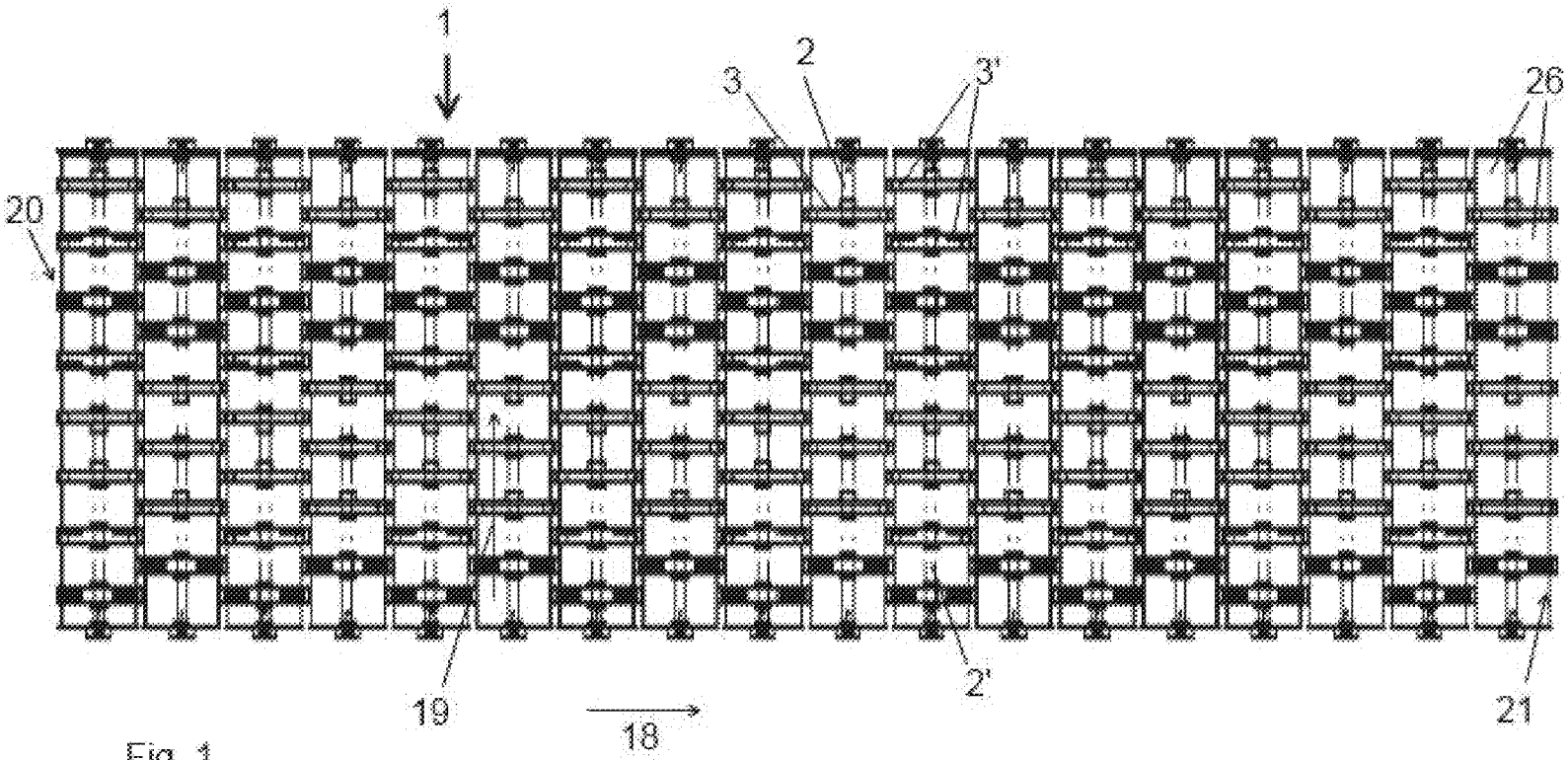
FIG. 1 is a schematic top view of a part of an example of a sorting screen according to the invention.

First, an example of a sorting screen 1 as shown in FIG. 1 is described. The sorting screen 1 is equipped with a row of rotatable shafts 2 mutually spaced in a conveying direction 18 and drivable in a common sense of rotation. Each shaft 2 extends transversally to the conveying direction 18. For driving rotation of the shafts 2, the shafts are coupled in a manner known per se to a motor via a drive train. Each of the shafts 2 carries a row of radially projecting rotor bodies 3 for intermittently urging material on the sorting screen conveyor upward and in conveying direction 18 when the shafts 2 are driven for rotation in a sense in which the upper parts of the rotor bodies 3 move with a directional component in the conveying direction 18. The rotor bodies 3 of each of the rows are mutually spaced in longitudinal direction 19 of the respective shaft 2. In operation, the circumference of each rotor body 3 moves rotationally along a rotary trajectory and the rotary trajectories of the rotor bodies 3 carried by each of the shafts 2 project between rotary trajectories of the rotor bodies 3' carried by a neighboring one of the of the shafts 2'. Neighboring rotor bodies are spaced by tubular spacers 26, which can be formed by tubes having a length and wall thickness. A rotor body 3 carried by a shaft 2 projects between rotor bodies 3' carried by a neighboring one of said shafts 2'. Between neighboring rotor bodies and between the periphery of rotor bodies on one shaft 2 and the spacers 26 of a neighboring one of the shafts 2', open passages are left through which waste material that is sufficiently small and/or flexible can drop. By replacing the tubular spacers by tubular spacers having a different outer diameter the sorting screen 1 can thus sieve or sort materials of different sizes. Meanwhile, the intermittent motion imparted by the rotating rotor bodies onto the material to be sorted loosens material that is clinging together and brings objects of the material that has not dropped through above next openings in different orientations, so that most objects that can drop through when in a suitable orientation do eventually drop through the sorting screen.

Figure 2B:
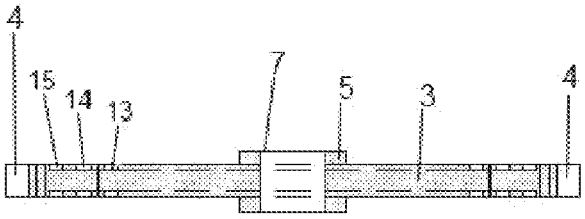
FIGS. 2A, 2*b* and 2C are a front view, a cross-sectional view and a perspective view, respectively, of a rotor body according to the invention.
Figure 2C:
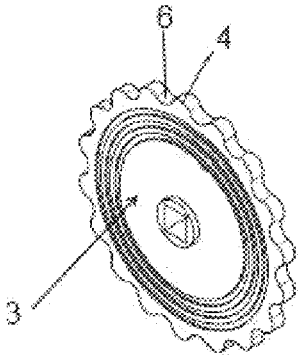
Figure 2A:
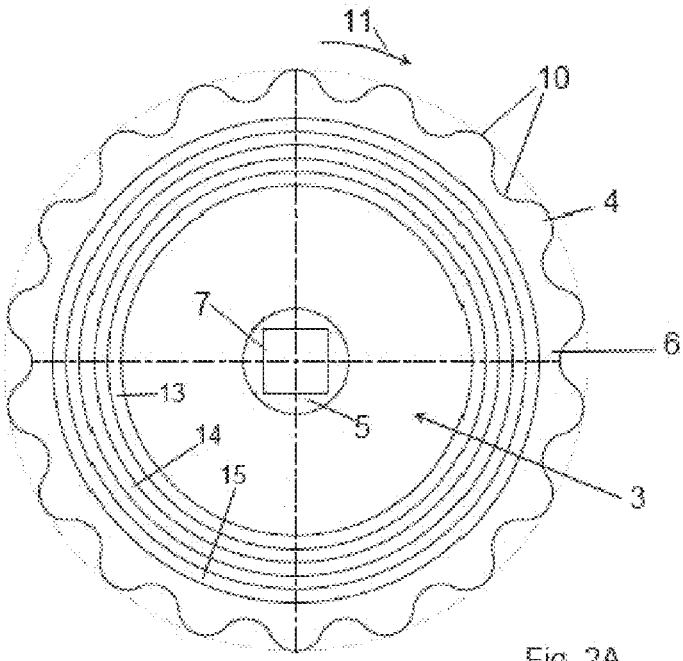

In FIGS. 2A, 2B and 2C an example of a rotor body 3 is shown, having an integrated hub 5 and an outer circumference 10 having a number of radial projections 4 and intermediate recessed portions 6. The hub 5 forms a central body portion extending around a square hole 7 forming a central passage for receiving a shaft 2. The square shape of the hole 7 locks the rotor body 3 against rotation relative to the square shaft 2, so that the rotor body 3 is reliably entrained with rotation of the shaft 2. In operation, the rotor body 3 rotates with the shaft 2 around a central axis of the shaft 2, the rotor body 3 and the square hole 7. Instead of a square hole 7, the central passage may have any other form. However, a form other, than circular, such as hexagonal or triangular, is advantageous for providing a form locked fixation about a shaft that is suitably shaped to project outside a largest circular contour within the passage. If the hole is circular a key or room for a key may be provided to reliably entrain the rotor body with rotation of the shaft.

The rotor body 3 according to the present example is provided with eighteen rotor projections 4 projecting radially outwardly from the hub 5 and oriented along a common plane of rotation. Instead of with eighteen rotor projections, the rotor body may be provided with a different number of rotor projections 4. However, to keep variations in the size of the passage along the perimeter of the rotor bodies fairly limited, while providing a high frequency of upward impulses to material on the screen adjacent to each passage, it is preferred that the number of rotor fingers of each rotor body is at least fourteen.

In operation, the sorting screen 1 can for instance sort waste material, such as general household waste, dry co-mingled waste mainly composed of paper, cardboard, glass and plastic waste, or waste paper and cardboard, including flexible, elongated, material, such as fiber, tape, ribbon, rope, cable, wire and/or string material and biological material. The shafts 2 and the rotor bodies 3 mounted thereto are rotated in the first sense of circulation 11 in which upper portions of the rotor bodies move in the direction of transport 18. When waste material is deposited onto an upstream end portion 20 of the sorting screen 1, the rotating shafts 2 convey the waste material in the conveying direction 18. A relatively fine and/or flexible fraction of the material falls through the sorting screen 1 and is collected underneath and a relatively coarse and/or stiff fraction of the material is displaced over the sorting screen 1 and discharged from a downstream end portion 21 of the sorting screen 1.

The rotor body 3 is preferably made of a plastic or elastomeric material, for instance rubber. More in general, it is preferred that the material is quite elastic and preferably has an e-modulus of less than 0.1 GPa and more than 15 MPa, the e-modulus preferably being between 20-30 MPa. For resiliently absorbing impacts and reducing noise emissions, the material is preferably quite soft and preferably has a hardness between 30 Shore A and 90 Shore A, the hardness preferably being between 70 Shore A and 80 Shore A, preferably 73+/-5° Shore A.

Each rotor body 3 is provided with a plurality of recesses, in the embodiment shown formed by circular grooves 13, 14, 15, having a different internal diameter and each having a width which matches the wall thickness of a respective end of a tubular spacer 26 to receive and retain the end of a tubular spacer. In different embodiments the grooves can be replaced by a suitable number of projections projecting outwardly from the rotor body for retaining end faces of tubular spacers of different diameters. In case the sorting screen is to be used for sorting waste material of a single size only, the rotor bodies can comprises a single circular groove only to retain a respective tubular spacer and even in this case such a construction provides advantages in particular with regard to maintenance and replacement of defective rotor bodies.

Although in FIG. 1 the outer diameter of the spacers is shown as being identical for all the shafts a sorting screen according to a non-shown embodiment of the invention can contain a number of sections positioned adjacent one another in transport direction 18, in which the outer diameter of the spacers mounted on shafts within one section differs from the outer diameter of the spacers in another section. In this manner within each section material of a different size can be sorted. Preferably, the sections are arranged such that the outer diameter of the spacers reduces from the upstream end portion 20 of the sorting screen 1 to the downstream end portion 21 of the sorting screen 1.

The invention claimed is:

1. A sorting screen for sorting material, comprising a row of rotatable, driven shafts mutually spaced in a conveying direction and each extending transversally to said conveying direction, said shafts each carrying a row of radially extending rotor bodies for intermittently urging material on the screen upward and in conveying direction, the rotor bodies of each of said rows being mutually spaced in longitudinal direction of the respective shaft by spacers retained between side faces of adjacent rotor bodies, wherein a rotor body carried by a shaft projects between rotor bodies carried by a neighboring one of said shafts, each spacer is a tubular spacer, each rotor body side face retaining an end of a spacer is provided with at least a plurality of recesses or a plurality of a number of projections, each for retaining a respective end face of a respective tubular spacer, and wherein at least one of said recesses or of said projections is arranged for retaining an end face of a tubular spacer of a first different diameter and at least another one of said recesses or of said projections is arranged for retaining an end face of a tubular spacer of a second diameter different from said first diameter.

2. A sorting screen according to claim 1, wherein each rotor body is made of a plastic or elastomeric material.

3. A sorting screen according to claim 1, wherein each rotor body has an outer circumference with a plurality of radial projections circumferentially distributed around a central axis of rotation and projecting radially outwardly from the axis of rotation relative to intermediate recessed portions of the outer circumference.

4. A sorting screen for sorting material, comprising a row of rotatable, driven shafts mutually spaced in a conveying direction and each extending transversally to said conveying direction, said shafts each carrying a row of radially extending rotor bodies for intermittently urging material on the sorting screen upward and in conveying direction, the rotor bodies of each of said rows being mutually spaced in longitudinal direction of the respective shaft by spacers, wherein a rotor body carried by a shaft projects between rotor bodies carried by a neighboring one of said shafts, each spacer is a tubular spacer, each rotor body is provided with at least a recess retaining a respective end face of a respective tubular spacer and is formed by a circular groove.

5. A sorting screen according to claim 4, wherein each rotor body comprises three circular grooves of different diameter.

6. A rotor body for sorting material, comprising a row of rotatable, driven shafts mutually spaced in a conveying direction and each extending transversally to said conveying direction, said shafts each carrying a row of radially extending rotor bodies for intermittently urging material on the sorting screen upward and in conveying direction, the rotor bodies of each of said rows being mutually spaced in longitudinal direction of the respective shaft by spacers, wherein a rotor body carried by a shaft projects between rotor bodies carried by a neighboring one of said shafts, each spacer is a tubular spacer, wherein said rotor body is provided, on each side face, with at least a plurality of recesses or a plurality of projections, for retaining a respective end face of a respective tubular spacer, and wherein at least one of said recesses or of said projections is arranged for retaining an end face of a tubular spacer of a first diameter and at least another one of said recesses or of said projections is arranged for retaining an end face of a tubular spacer of a second diameter different from said first diameter.

7. A rotor body according to claim 6, wherein the rotor body is made of a plastic or elastomeric material.

8. A rotor body according to claim 6, wherein the rotor body has an outer circumference with a plurality of radial projections circumferentially distributed around a central axis of rotation and projecting radially outwardly from the axis of rotation relative to intermediate recessed portions of the outer circumference.

9. A rotor body for sorting material, comprising a row of rotatable, driven shafts mutually spaced in a conveying direction and each extending transversally to said conveying direction, said shafts each carrying a row of radially extending rotor bodies for intermittently urging material on the sorting screen upward and in conveying direction, the rotor bodies of each of said rows being mutually spaced in longitudinal direction of the respective shaft by spacers, wherein a rotor body carried by a shaft projects between rotor bodies carried by a neighboring one of said shafts, each spacer is a tubular spacer, wherein said rotor body is provided with at least a recess for retaining a respective end face of a respective tubular spacer, wherein the recess is formed by a circular groove.

10. A rotor body according to claim 9, wherein the rotor body comprises at least one further circular groove concentric with said circular groove, said grooves being of mutually different diameters.

* * * * *